United States Patent [19]

Miura et al.

[11] 4,114,432

[45] Sep. 19, 1978

[54] COIL WINDING APPARATUS

[75] Inventors: Yoshio Miura; Kazuhiro Kobayashi; Koue Yusa, all of Hitachi, Japan

[73] Assignee: Hitachi, Ltd., Japan

[21] Appl. No.: 797,691

[22] Filed: May 17, 1977

[30] Foreign Application Priority Data

May 24, 1976 [JP] Japan ..... 51-59151

[51] Int. Cl.[2] ..... B21F 3/02

[52] U.S. Cl. ..... 72/135; 72/145; 72/169; 72/171; 72/174

[58] Field of Search ..... 72/135, 137, 140, 141, 72/145, 169, 171, 174, 175; 140/88; 242/72 R, 76, 110.1

[56] References Cited

U.S. PATENT DOCUMENTS

| | | | |
|---|---|---|---|
| 928,073 | 7/1909 | Schneider | 72/171 |
| 928,220 | 7/1909 | Schneider | 72/171 |
| 972,928 | 10/1910 | Schneider | 72/171 |
| 2,833,329 | 5/1958 | De Poy | 140/88 X |
| 2,870,522 | 1/1959 | Hickman et al. | 72/137 |

FOREIGN PATENT DOCUMENTS

| | | | |
|---|---|---|---|
| 40-13,656 | 7/1965 | Japan | 72/135 |
| 905,027 | 9/1962 | United Kingdom | 72/145 |

*Primary Examiner*—E. M. Combs
*Attorney, Agent, or Firm*—Craig & Antonelli

[57] ABSTRACT

Apparatus for winding a linear, elongated object into a coil including a bending roller assembly for bending the linear, elongated object into loops of the coil, and a leveling device for bringing the curvature of the coil to a predetermined level. The leveling device includes a base movable toward and away from the bending roller assembly so as to adjust the spacing between the bending roller assembly and the base, a plurality of sliders supported by the base and located circumferentially of the coil in spaced relation to one another for movement in sliding motion toward and away from the center of curvature of the coil, a plurality of leveling roller assemblies each supported by one of the sliders for imparting a bending moment to the coil to correct the curvature thereof to a desired value, and an actuator for radially positioning the sliders in accordance with the spacing between the bending roller assembly and the base. One of the two adjacent leveling roller assemblies imparts a bending moment to the coil in a direction which is opposite to the direction in which the other leveling roller assembly imparts a bending moment to the coil.

10 Claims, 8 Drawing Figures

COIL WINDING APPARATUS

BACKGROUND OF THE INVENTION

1. Field of the Invention

This invention relates to improvements in or relating to apparatus for forming a linear, elongated object, or more specifically an elongated electric conductor used with transformers, reactors, electric induction furnaces, etc., into cylindrical coils.

2. Description of the Prior Art

Generally, coils used with transformers, electric induction furnaces, etc. are formed by shaping a linear, elongated conductor into loops of the coils and winding same in cylindrical form. Processes for forming coils include a hot bending process and a cold bending process. In the hot bending process, a linear, elongated conductor is heated and annealed, directly wound into a coil on a winding pattern with a strong force and struck with a hammer to apply pressure thereto so as to correct the diameter of the coil. In the cold winding process, a linear elongated conductor is continuously bent by means of a bender to form a coil of a cylindrical shape. The former process is low in operation efficiency because correction of the diameter of a coil to a predetermined value is effected by hammering. Thus the latter process is generally in use nowadays.

FIG. 1 shows one example of the coil winding apparatus for carrying the cold bending process into practice. As shown, a linear, elongated conductor 1 is fed at a constant velocity in a direction *a* toward a bending roller assembly 6 by means of pinch rollers 4 and 5 of a conductor feeding device 3 mounted on base 1. The linear conductor 1 fed in this way is continuously bent by bending rollers 7, 8 and 9 of the bending roller assembly 6 into loops 10 and shaped into a cylindrical coil 12 shown in FIG. 2. In this apparatus, the bending rollers 7 and 9 are rotated in a direction *b* in synchronism with the movement of the linear conductor 1 which is fed in the direction *a*, while the bending roller 8 is permitted to rotate freely in a direction *c* and to move in a direction *e*, so that the linear conductor 1 can be held between the bending rollers 7 and 9 on the one hand and the bending roller 8 on the other hand. Thus the linear conductor 1 is continuously bent into the loops 10 by moving the bending roller 8 in the direction *e* to form the loops 10 of the cylindrical coil 12. Each loop 10 of the coil 12 falls downwardly by its own weight on to a rotary table 14 of a winding device 13, the rotary table 14 being rotated in a direction *g* in synchronism with the movement of the loop 10 of the coil 12 which is fed in a direction *f* and at the same time moved downwardly in accordance with the distance covered by the downward movement of the loops 10 of the coil 12. Thus the linear conductor 1 can be continuously formed into the loops 10 by means of the bending roller assembly 6 to produce the cylindrical coil 12.

Some disadvantages are associated with the coil winding apparatus shown in FIGS. 1 and 2. They are as follows:

1. The loops 10 of the cylindrical coil 12 are formed by continuously bending the linear conductor 1 by means of the bending rollers 7, 8 and 9 solely by relying on the resilience of the material of the conductor 1, so that the loops 10 may vary from one another in diameter and shape and have different diameters $d_1$, $d_2$ and $d_3$, for example. Usually, allowable tolerances of the diameter of the loops of a coil must fall within the limits of ± 3 mm, but the loops 10 of the coil 12 produced by this apparatus differ from one another in diameter such that the difference in value range from ± 5 mm to ± 10 mm.

2. As the operation of winding the coil 12 progresses, the loops 10 formed by bending the linear conductor 1 by means of the bending roller assembly 6 vary from one another in diameter, with the result that the loops 10 extend alternately to right and left in zigzag form as shown in FIG. 2. This makes it impossible to produce the cylindrical coil 12 which stands upright on the rotary table 14.

SUMMARY OF THE INVENTION

An object of this invention is to provide a coil winding apparatus which enables a cylindrical coil to be produced without giving rise to variations in the diameter of loops of the cylindrical coil.

Another object is to provide a coil winding apparatus which enables cylindrical coils of different diameters to be produced as desired.

According to the invention, there is provided a coil winding apparatus for producing a coil by winding a linear, elongated object, such apparatus comprising means for bending the linear, elongated object into loops of the coil, and a device for determining the diameter of the coil, such device for determining the diameter of the coil including a base, a plurality of roller assemblies supported by the base and arranged in spaced relation circumferentially of each loop of the coil formed of the linear, elongated object fed by the bending means so that the roller assemblies can impart bending moments to each loop of the coil to correct the curvature of the coil to a desired value, and positioning means for positioning the roller assemblies radially of each loop of the coil with respect to the center of curvature of the coil in accordance with the spacing between the base and the bending means.

DESCRIPTION OF THE PREFERRED EMBODIMENT

The present invention will now be described in detail with reference to FIGS. 3 to 8.

Figure 1:
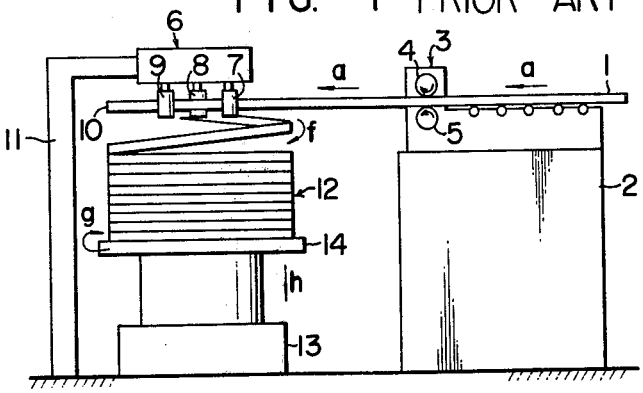
FIG. 1 PRIOR ART
FIG. 1 is a schematic vertical sectional view of a coil winding apparatus of the prior art.
Figure 2:
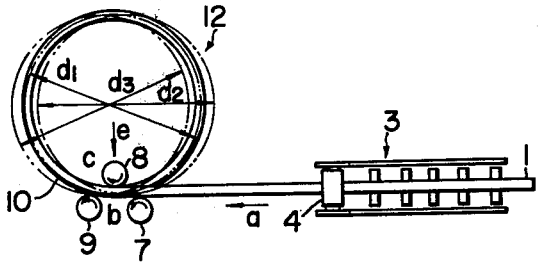
FIG. 2 PRIOR ART
FIG. 2 is a schematic plan view of the apparatus shown in FIG. 1, with certain parts removed, in explanation of the operation for bending a linear conductor.
Figure 3:
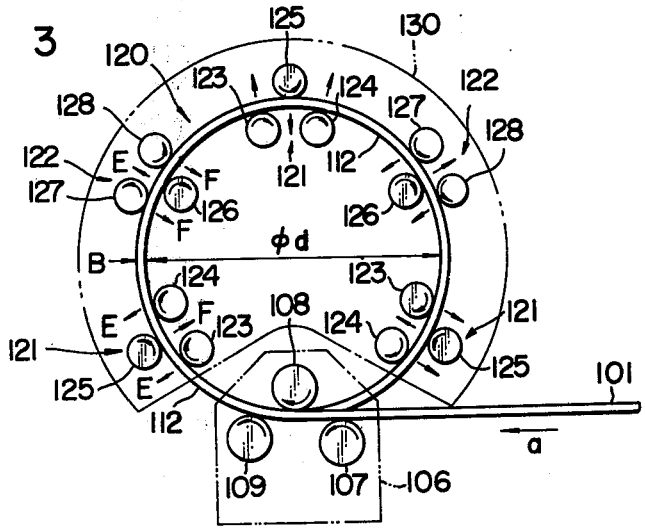
FIG. 3 is a schematic plan view of the leveling device of the coil winding apparatus comprising one embodiment of the present invention.

Referring to FIG. 3, a linear, elongated conductor 101 is introduced into a bending roller assembly 106 comprising a roller 108 located on one side of the elongated conductor 101 and two rollers 107 and 109 located on the other side of the conductor 101. Being held between these rollers 107, 108 and 109, the elongated conductor 101 is bent circularly to form a loop of a coil 112 by having imparted thereto a bending moment by each of the rollers 107, 108 and 109.

The conductor bent circularly to form the loop of the coil 112 is led into a leveling device 120 where the loop of the coil 112 has its diameter determined at a predetermined value *d*. The leveling device 120 includes a base 130, and a plurality of leveling roller assemblies 121 and 122 supported by the base 130 and located in circumferentially spaced relation with respect to the loop of the coil 112. Of the two adjacent leveling roller assemblies 121 and 122, one assembly 121 comprises two rollers 123 and 124 located radially inwardly of the loop of coil 112 and one roller 125 located radially outwardly thereof, and the other assembly 122 comprises one roller 126 located radially inwardly of the loop of the coil 112 and two rollers 127 and 128 located radially outwardly thereof.

Figure 4:
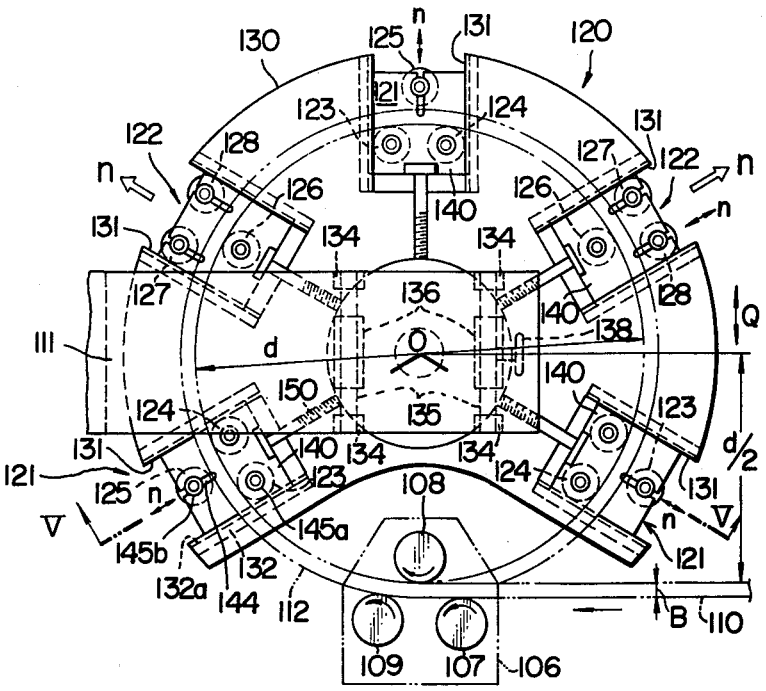
FIG. 4 is a detailed plan view of the leveling device shown in FIG. 3.
Figure 5:
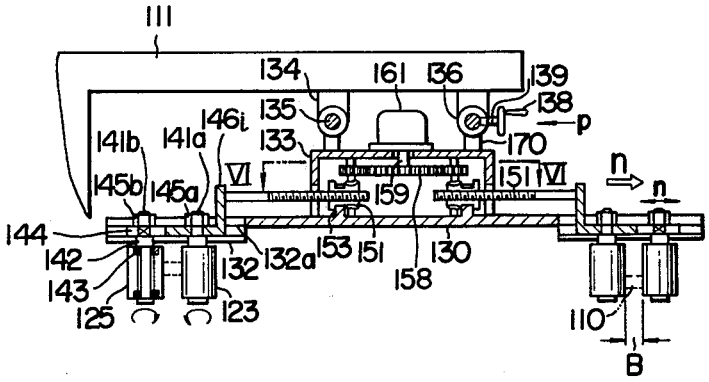
FIG. 5 is a vertical sectional view taken along the line V—V of FIG. 4.
Figure 6:
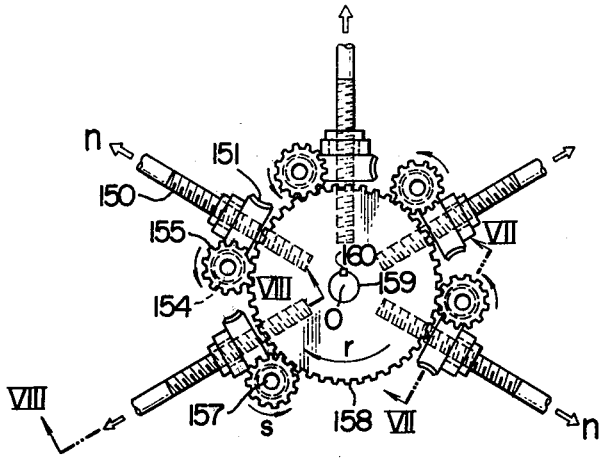
FIG. 6 is a sectional view taken along the line VI—VI of FIG. 5.

Referring to FIGS. 4 and 5, the base 130 is formed with five cutouts 131 formed at its edge and located in circumferentially spaced relation. In each cutout 131, an L-shaped elongated member 132 is attached to the underside of the base 130 in a manner to extend along the inwardly facing surface of the cutout 131. Each L-shaped elongated member 132 and the underside of the base 131 defines therebetween a guide groove 132*a*. In the guide groove 132*a* of each cutout 131, a slider 140 is fitted for sliding motion radially of the loop of the coil 112.

The base 130 is located in spaced juxtaposed relation to a fixed support bar 111. Two pairs of plates 134 each have one end secured to the underside of the fixed support bar 111 and extend vertically downwardly therefrom. A rod 135 extends between each pair of plates 134 and has fitted thereover a cylindrical member 136 for sliding movement. Each cylindrical member 136 is secured through a connecting member 170 to a frame 133 which in turn is secured to the base 130. A handle 138 has a threaded shaft portion 139 which is threadably engaged in a threaded opening formed in a wall of one of the cylindrical members 136. If the handle 138 is turned, the threaded shaft portion 139 abuts at its forward end against the rod 135 so as to thereby lock the cylindrical members 136 and prevent their movement relative to the rods 135.

If the handle 138 is turned and the cylindrical members 136 are unlocked to permit the same to move freely relative to the rods 135, the base 130 can be moved toward or away from the bending roller assembly 106 or in directions indicated by the letter Q in FIG. 4. In this way, the spacing between the bending roller assembly 106 and the base 130 can be adjusted in such a manner that the spacing is one-half the diameter *d* of the loop of the coil 112. At this time, the handle 138 is turned in the reverse direction to lock the cylindrical members 136 to prevent their movement relative to the rods 135. By adjusting the spacing between the bending roller assembly 106 and the center 0 of the base 130, it is possible to produce coils differing in diameter from one another over a wide range of values.

Each slider 140 is formed therein with one or two openings located radially inwardly of the loop of the coil 112 and each receiving therein a rod 141*a* (FIG. 5) including a lower end having a head, a threaded upper end portion and an increased diameter portion interposed between the lower and upper ends. Rollers 123, 124 and 126 of the leveling roller assemblies 121 and 122 which are located radially inwardly of the loop of the coil 112 are rotatably supported through bearings by the rods 141*a* in a manner to be interposed between the lower head and the intermediate increased diameter portion. The threaded upper end portion of each rod 141*a* extends upwardly through each slider 140, and a nut 145*a* threadably engages the upper end portion of the rod 141*a* to fixedly secure the rod 141*a* to each slider 140.

Each slider 140 is additionally formed therein with one or two slots 144 located radially outwardly of the loop of the coil 112 and each receiving a rod 141*b* for movement therein. Each rod 141*b* has a lower end having a head, a threaded upper end portion, and an increased diameter portion 142 (FIG. 5) interposed between the lower and upper ends. Rollers 125, 127 and 128 of the leveling roller assemblies 121 and 122 which are located radially outwardly of the loop of the coil 112 are rotatably supported through bearings 143 by the rods 141*b* in a manner to be interposed between the lower head and the intermediate increased diameter portion 142. The threaded upper end portion of each rod 141*b* extends upwardly through each slider 140, and a nut 145*b* threadably engages the upper end portion of each rod 141*b*. Thus, by loosening the nuts 145*b* and moving the rods 141*b* in the slots 144, it is possible to adjust the spacing between the rollers of the leveling roller assemblies 121 and 122 which are located radially inwardly of the loop of the coil 112 and the rollers thereof which are located radially outwardly of the loop of the coil 112 in accordance with the diameter of the elongated conductor 110.

Figure 7:
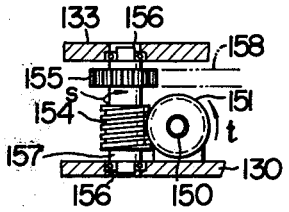
FIG. 7 is a sectional view taken along the line VII—VII of FIG. 6.
Figure 8:
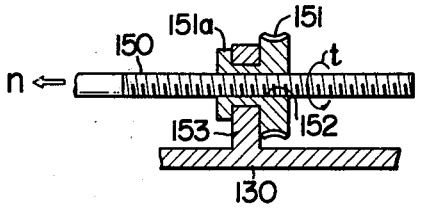
FIG. 8 is a sectional view taken along the line VIII—VIII of FIG. 6.

Each slider 140 has a radially inner end thereof to which is connected a flange 146*i* extending upwardly. Threaded shafts 150 have radially outer ends thereof connected respectively to the flanges 146*i* of the sliders 140, and extend from the flanges 146*i* toward the center 0. The threaded shafts 150 have threaded portions, respectively which are in mesh with internally threaded members 152, respectively. The internally threaded members 152 are rotatably mounted on the base 130 through bearings 153, respectively, as is best shown in FIG. 8. Thus, the rotation of the internally threaded member 152 in the direction *t* causes the threaded shaft 150 to radially move in the direction shown by an arrow *n*. Each internally threaded member 152 has one end thereof to which a flange 151*a* is connected, and the other end to which a worm wheel 151 is connected, with the bearing 153 positioned between the flange 151*a* and the worm wheel 151 to prevent the internally threaded member 152 from being radially moved. As shown in FIG. 7, each worm shaft 157 is rotatably mounted between the base 130 and the frame 133 through bearings 156. The worm shaft 157 has mounted thereon a worm 154 and a pinion 155. The worm 154 is in mesh with the worm wheel 151. Thus, the rotation of the worm wheel 151 in the direction *t* causes the worm 154 and the pinion 155 to be rotated in the direction *s*. The pinion 155 is in mesh with a spur gear 158 which is fixedly mounted through a key 160 on a shaft 159. The shaft 159 is, as shown in FIG. 5, connected to a motor 161 with a brake which is mounted on the frame 133.

The operation of the leveling device of the coil winding apparatus according to the invention will now be described. Upon actuation of the motor 161, the spur gear 158 rotates in the direction of an arrow *r* in FIG. 6. This causes pinions 155, which are located circumferentially of the spur gear 158 in spaced relation to one another, to rotate simultaneously in the direction of an arrow *s*. When the pinions 155 rotate, the worms 154 each of which acts as a unit with one of the pinions 155 as shown in FIG. 7 rotate in the direction of the arrow *s*, and cause worm wheels 151 to rotate in the direction of an arrow *t*. Since each worm wheel 151 is freely rotatable within the bearing 153 as shown in FIG. 8, the threaded shaft 150 in engagement with the internally threaded portion 152 moves in the direction of an arrow *n*. This results in the sliders 140, each connected to one of the threaded shafts 150, moving radially in the direction of the arrow *n* from the center 0. Thus, it is possible to automatically bring the leveling roller assemblies 121 and 122 to positions in which the curvature of the loop of the coil 112 can be determined in a manner to set the diameter of the loop of the coil 112 at a value *d* as shown in FIG. 5.

The leveling roller assemblies 121 and 122 brought to the predetermined positions operate as set forth below. The conductor 110 which is bent circularly to be formed into loops of the coil 112 by the bending roller assembly 106 is bent in the direction of an arrow E by the inwardly disposed roller 123 of the first leveling roller assembly 121, then bent by the outwardly disposed roller 125 thereof in the direction of an arrow F which is opposite to the direction of the arrow E, and finally bent by the inwardly disposed roller 124 in the direction of the arrow E which is opposite to the direction of the arrow F as shown in FIG. 3. As the circularly bent conductor 110 is passed through the next following leveling roller assemblies 121 and 122, the conductor 110 is repeatedly subjected to the aforesaid action of the rollers, so that the circularly bent conductor 110 can be formed into a loop of the coil 112 of a predetermined diameter. The leveling roller assemblies 121 and 122 are arranged in such a manner that the two adjacent roller assemblies act to bend the conductor in opposite directions, so that the radius of curvature of the loop of the coil 112 which has been circularly bent by the bending roller assembly can be corrected by the leveling roller assembly in a manner to set the inner diameter of the coil 112 at a predetermined value.

The coil winding apparatus constructed and operating as aforesaid offers the following advantages:

1. In the apparatus, the conductor 101 is circularly bent by the bending roller assembly 106 to form a loop of the coil 112, and rollers of the plurality of leveling roller assemblies 121 and 122 are located circumferentially of the loop of the coil 112 in a manner to be disposed radially inwardly and radially outwardly of the loop of the coil 112. Of the two adjacent leveling roller assemblies, one leveling roller assembly imparts a bending moment to the loop of the coil 112 in a direction which is opposite to the direction which the other leveling roller assembly imparts a bending moment thereto. Thus, the loop of the coil 112 held by the rollers of the leveling roller assemblies 121 and 122 can have its radius of curvature automatically corrected in such a manner that the loop of the coil 112 has a predetermined diameter. By using the apparatus according to the invention, it is possible to readily and positively produce a large number of coils of the same diameter.

2. The leveling roller assemblies 121 and 122 comprise inner and outer rollers 123 to 128, and each leveling roller assembly is supported by one of the sliders 140. The sliders 140 are each connected to one of the threaded shafts 150 which can be moved simultaneously in a radial direction by means of the electric motor 161 through the gearing. By this feature, it is possible to bring the plurality of leveling roller assemblies to desired positions when alteration is made to the diameter of coils to be produced.

3. The rollers 125, 127 and 128 of the leveling roller assemblies 121 and 122 which are located radially outwardly of the loop of the coil 112 formed by the bending roller assembly 106 and adapted to contact the loop of the coil 112 at its outer side can be moved in the direction of the arrow *n* in the slots 144 formed in the sliders 140. Thus it is possible to adjust the spacing between the inner leveling rollers brought into contact with the inner side of the loop of the coil and the outer leveling rollers brought into contact with the outer side thereof in accordance with the diameter B (See FIG. 5) of the conductor 110. By this feature, the apparatus according to the invention can be readily adapted to handle conductors of different sizes.

In the embodiment shown and described hereinabove, the leveling roller assemblies are five in number. It is to be understood, however, that the invention is not limited to this number of the leveling roller assembly and that the number of the leveling roller assemblies may be increased or decreased depending on the diameter of the loops of coils to be produced. Also, the leveling roller assemblies are moved in the direction of the arrow *n* by the action of the electric motor provided with a brake as described with reference to FIG. 5. However, it is to be understood that other rotating mechanisms, such as a hydraulic motor, may be used.

From the foregoing description, it will be appreciated that the present invention makes it possible to automatically correct by means of the sliders the radius of curvature of a loop of a coil so that the coil will have a predetermined diameter.

What is claimed is:

1. A coil winding apparatus for producing a coil from a linear, elongated object, comprising:

a bending roller assembly for imparting a bending moment to the elongated object to form the coil; and a leveling device for correcting the diameter of the coil, said leveling device including a plurality of leveling roller assemblies arranged in spaced relation circumferentially of the coil, one of at least two adjacent leveling roller assemblies imparting a bending mement to the coil in the direction opposite to the direction of a bending moment imparted by the other adjacent leveling roller assembly to the coil, sliders associated one with each of said leveling roller assemblies for supporting the same, each of said sliders having at one end thereof a threaded shaft, and a rotational driving source for rotating said shafts to simultaneously radially slide said sliders.

2. A coil winding apparatus as claimed in claim 1, wherein alternating assemblies of said plurality of leveling roller assemblies include an odd number of rollers located radially inwardly of the coil and rollers of an even number located radially outwardly thereof, and wherein the assemblies of leveling rollers between said alternating assemblies include rollers of an even number located radially inwardly of each loop of the coil and at least one roller of an odd number located radially outwardly thereof, thereby imparting said oppositely directed bending moments.

3. A coil winding apparatus as claimed in claim 2, wherein said leveling device further includes means for adjusting the radial spacing between the rollers located radially inwardly of the coil and the rollers located radially outwardly thereof in each each of said leveling roller assemblies.

4. A coil winding apparatus as claimed in claim 1, wherein said leveling device further includes a base for supporting thereon said sliders, said sliders extending toward the center of curvature of the coil, a plurality of rotatable worm wheels each fitted over one of said threaded shafts, and a plurality of worms each in engagement with one of the worm wheels through a pinion, said drive source rotating said worms to radially position said sliders with respect to the center of curvature of the coil in accordance with the spacing between said base and said bending roller assembly.

5. A coil winding apparatus as claimed in claim 4, wherein one of the two adjacent leveling roller assemblies includes at least one roller of an odd number located radially inwardly of the coil and rollers of an even number located radially outwardly thereof, and the other leveling roller assembly includes rollers of an even number located radially inwardly of the coil and at least one roller of an odd number located radially outwardly thereof.

6. A coil winding apparatus as claimed in claim 5, wherein each of said sliders is formed therein with at least one radially oriented slot, and each of the rollers of the respective leveling roller assembly located either radially outwardly or inwardly of the coil is slidably received in said slot whereby the radial spacing between the rollers located radially inwardly of the coil and the rollers located radially outwardly thereof can be adjusted.

7. A coil winding apparatus as claimed in claim 1, wherein said leveling device further includes a base supporting thereon said sliders and comprising means for adjusting the spacing between said base and said bending roller assembly.

8. A coil winding apparatus as claimed in claim 7, further comprising a fixed support bar means, and wherein said spacing adjusting means includes rods supported by said fixed support means, cylindrical sliding members mounted on said base and each slidably fitted over one of said rods, and means mounted on said base for locking said cylindrical sliding members to said rods.

9. A coil winding apparatus as claimed in claim 2, wherein said rollers each have an outer peripheral surface permitting each loop of the coil to be moved downwardly by gravity.

10. A coil winding apparatus for producing a coil from a linear, elongated object, comprising:

a bending roller assembly for imparting a bending moment to the elongated object to form the coil; and a leveling device for correcting the diameter of the coil, said leveling device including a plurality of leveling roller assemblies arranged in spaced relation circumferentially of the coil, one of at least two adjacent leveling roller assemblies imparting a bending moment to the coil in the direction opposite to the direction of a bending moment imparted by the other adjacent leveling roller assembly to the coil, wherein alternating assemblies of said plurality of leveling roller assemblies include an odd number of rollers located radially inwardly of the coil and rollers of an even number located radially outwardly thereof, and wherein the assemblies of leveling rollers between said alternating assemblies include rollers of an even number located radially inwardly of each loop of the coil and at least one roller of an odd number located radially outwardly thereof, thereby imparting said oppositely directed binding moment.

* * * * *